United States Patent [19]

Gelber

[11] Patent Number: 4,785,597

[45] Date of Patent: Nov. 22, 1988

[54] MULTIPLE STORE STRUCTURE

[76] Inventor: Eleaizer Gelber, c/o 1550 de Maisonneuve Blvd. West, Suite 1155, Montreal, Quebec, Canada, H3G 1N2

[21] Appl. No.: 75,135

[22] Filed: Jul. 20, 1987

[51] Int. Cl.[4] ..... E04H 1/00

[52] U.S. Cl. ..... 52/236.3; 52/64; 52/126.5

[58] Field of Search ..... 52/234, 236.3, 64, 126.5, 52/125.1

[56] References Cited

U.S. PATENT DOCUMENTS

| | | | |
|---|---|---|---|
| D. 275,323 | 8/1984 | Miczewski | D25/59 |
| 381,361 | 4/1888 | Gooch | 52/204 X |
| 1,767,401 | 6/1930 | Reuter | D25/59 |
| 1,874,820 | 8/1932 | Simone | 52/204 X |
| 3,552,075 | 1/1971 | Grump | 52/234 X |
| 4,006,567 | 2/1977 | Flannery | 52/64 |

*Primary Examiner*—Carl D. Friedman

*Attorney, Agent, or Firm*—Fishman, Dionne & Cantor

[57] ABSTRACT

An entranceway is disposed in the front wall of the structure and a first storefront window arrangement is disposed on one side of the entranceway while a second storefront window arrangement is disposed on the other side of the entranceway. A first upper landing extends behind the first storefront window arrangement and a first lower landing, below the first upper landing, also extends behind the first storefront window arrangement. A second upper landing extends behind the second storefront window arrangement and a second lower landing, below the second upper landing, extends behind the second storefront window arrangement. An ascending stairway runs from the entranceway to the upper landings, and descending stairways run from the entranceway to the lower landings.

13 Claims, 3 Drawing Sheets

MULTIPLE STORE STRUCTURE

BACKGROUND OF INVENTION

1. Field of the Invention

The invention relates to a novel structure for the accommodation of a plurality of stores. More specifically, the invention relates to such a structure which makes the most efficient use of the frontage of the structure.

2. Description of Prior Art

In order to display their products to the passing trade, store owners desire as much storefront window space as they can get. More specifically, they desire as wide a storefront window as possible.

With present structures, wherein each store has its own entranceway on the front wall of the structure, the space used for the entranceway reduces storefront window space. For example, if a thirty feet wide structure houses four stores, each having a separate entranceway consisting of a three feet wide door, then only eighteen feet are available for storefront windows. If this space is evenly divided, each store will have a storefront window four-and-one-half feet wide. The twelve feet used for the doors cannot be again used for a storefront window.

Examples of present structures are illustrated in U.S. Pat. Nos. 381,361, Apr. 17, 1988, Gooch, U.S. Pat. No. 1,767,401, June 24, 1930, Reuter, U.S. Pat. No. 1,874,820, Aug. 30, 1932, Simone and U.S. Des. Pat. No. DES275,323, Aug. 28, 1984, Miczewski. As can be seen, a separate doorway is associated with each of the stores of the structures of the references.

SUMMARY OF INVENTION

It is an object of the invention to provide a structure for a plurality of stores which permits a wider storefront window space for each store than is possible with presently available structures.

It is a further object of the invention to provide such a structure having a single entranceway which may service up to four separate store units.

It is a still further object of the invention to provide such a structure which includes a storefront window arrangement on either side of the entranceway such that each storefront window arrangement may service up to two separate store units.

In accordance with the invention, an entranceway is disposed in the front wall of the structure, and a first storefront window arrangement is disposed on one side of the entranceway while a second storefront window arrangement is disposed on the other side of the entranceway. A first upper landing extends behind the first storefront window arrangement and a first lower landing, below the first upper landing also extends behind the first storefront window arrangement. The first upper landing accommodates a first store unit and the first lower landing accommodates a second store unit. Third and fourth store units are accommodated on a second upper landing and a second lower landing respectively behind the second storefront window arrangement. First access means extend from the entranceway and ascend to the upper landings to service the first and third store units, and second access means extend from the entranceway and descend to the lower landings to service the second and fourth store units.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
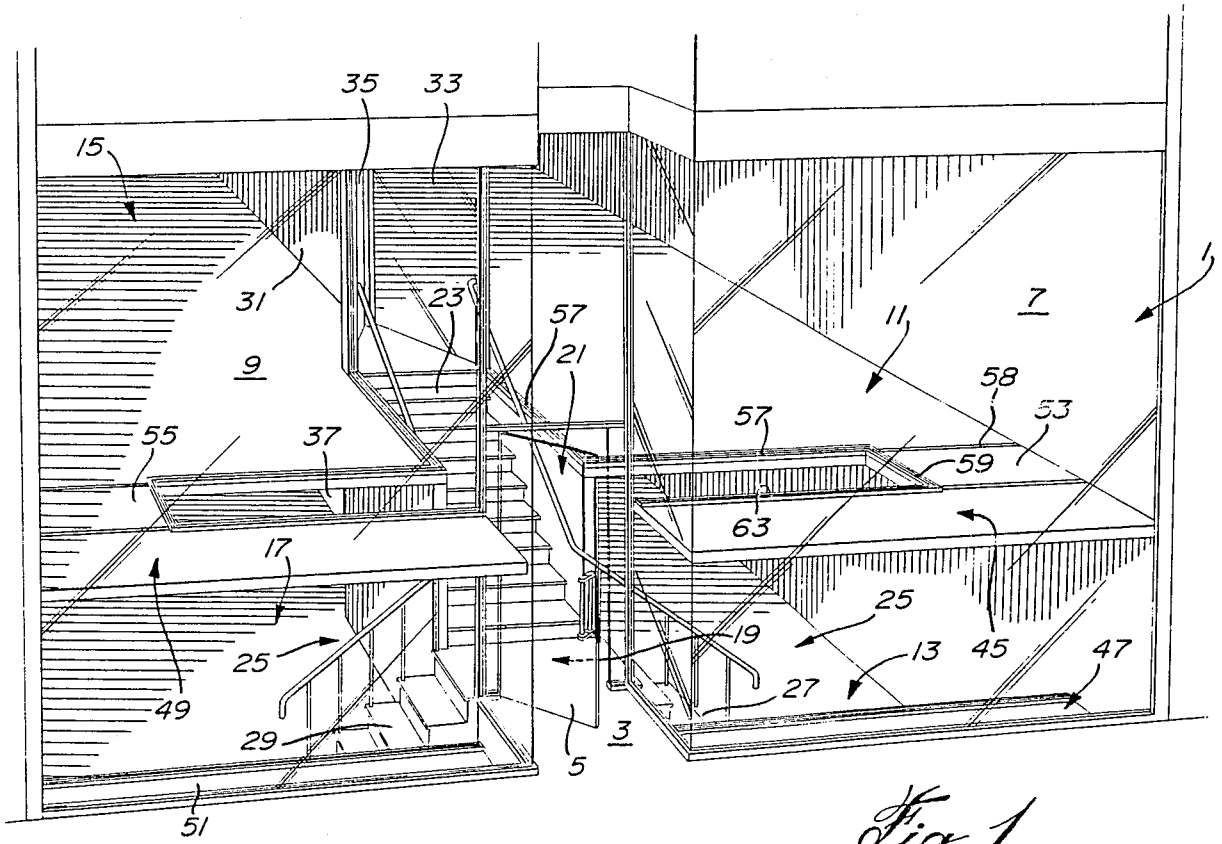
FIG. 1 is a perspective view of the structure.

Referring to the drawings, the structure includes a front wall, indicated generally at 1, having an entranceway 3 which includes a door 5. Disposed on one side of the entranceway 3 is a storefront window arrangement 7, and disposed on the other side of the entranceway 3 is a storefront window arrangement 9.

Extending behind the storefront window arrangement 7 is a first upper landing 11 and a first lower landing 13. Extending behind the storefront window arrangement 9 is a second upper landing 15 and a second lower landing 17. As can be seen, the first lower landing 13 is below the first upper landing 11, and the second lower landing 17 is below the second upper landing 15. Further, first upper landing 11 may be at the same level as second upper landing 15, and first lower landing 13 may be at the same level as second lower level 17.

The entranceway 3 includes a ground level landing 19 extending behind the door 5. Extending upwardly from the ground level landing is a first access means 21 comprising an ascending stairway 23. Extending downwardly from the ground level landing 19 is a second access means, indicated generally at 25, and including descending stairway 27 descending to first lower level 13, and descending stairway 29 descending to second lower level 17.

Divider wall 31 separates first upper landing 11 from second upper landing 15, and doorway 33 provides entrance to first upper landing 11 while doorway 35 provides entrance to second upper landing 15.

Figure 2:
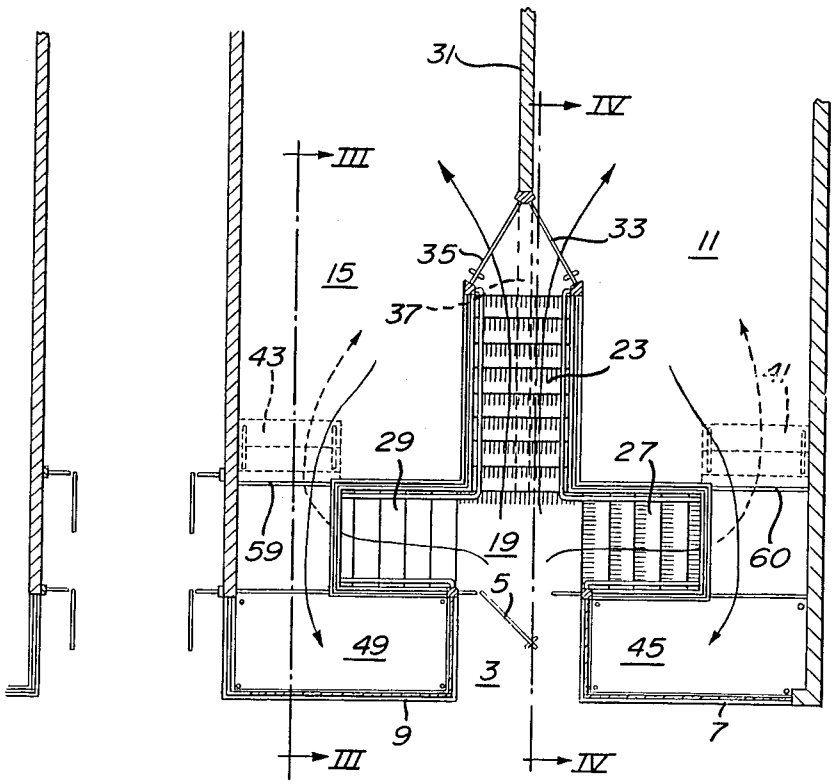
FIG. 2 is a top section.

Divider wall 37 (see FIG. 3) separates first lower landing 13 from second lower landing 17. The respective lower landings can be entered directly, as in FIG. 1, or they could be accessed through doors at lines 59 and 60 respectively which are followed by further stairways 41 and 43 respectively as shown in FIG. 2.

Associated with the first upper level may be a first upper display platform 45, and associated with the first lower level may be a first lower display platform 47. Associated with the second upper level 15 may be a second upper display platform 49 and associated with the second lower level 17 may be a second lower display platform 51. The upper display platforms 45 and 49 may be at the same level as the first upper landing 11 and the second upper landing 15 respectively and they are dividers to divide the storefront window arrangements into upper and lower storefront windows. Both platforms extend to the window lines of their respective storefront window arrangements. However, the lower display platforms 47 and 51 may be below ground level landing 19. Laneway 53 permits communication between first upper landing 11 and first upper display platform 45, and laneway 55 permits communication between second upper landing 15 and second upper display platform 49. Access to first lower display platform 47 and second lower display platform 49 is via stairways 27 and 29 respectively.

The first upper landing 11 and its associated and aligned first upper display platform 45 constitute a first store unit, and the first lower landing 13 and its associated and aligned first lower display platform 47 constitute a second store unit. The second upper landing 15 and its associated and aligned second upper display platform 49 constitute a third store unit while the second lower landing 17 and its associated and aligned second lower display platform 51 constitute a fourth store unit. Each store unit can constitute a separate store. Alternatively, a store can consist of the first and third store units and a second store can consist of the second store unit while a third store consists of the fourth store unit. Again, a first store can consist of the first and second store units while second and third stores are constituted by the third and fourth store units respectively. Finally, all four store units can constitute a single store. The particular separation of store units into stores is therefore flexible. However, regardless of how the store units are assembled to form stores, each store unit will have substantial amount of storefront window. In this regard, the storefront arrangement above the first upper display platform is associated with the first store unit and the storefront window arrangement below first upper display platform 45 is associated with the second store unit. In a like manner, the storefront window arrangement above the second upper display platform 49 is associated with the third store unit while the storefront window arrangement below the second upper display platform 49 is associated with the fourth store unit. Thus, if we revert to the example of the thirty feet wide structure discussed above, and if we assume a four feet wide door, and assuming that the storefront window arrangements 7 and 9 are equally divided, then each store unit will have a storefront window thirteen feet wide. This is obviously a great improvement over the example above discussed.

If each store unit is to constitute a separate store, then it would be desirable to have a lockable enclosure to surround the store unit when the store unit is closed. For this purpose, considering the first store unit, a foldable door could be run along the track 57. The foldable door would be folded away during operating hours and would be open to enclose the store unit during closing hours. A solid, for example, glass wall, could be disposed along the line 59. A glass wall could be run along the line 63 to close up the first upper display platform 45 during closing hours. The foldable doors could be glass doors so that both the merchandise on the display platforms and the merchandise in the stores would be on display even during closing hours. Similar arrangements could be used for enclosing the second, third and fourth store units. The movable walls and the doors would have locks whereby the movable walls and the doors would be lockable.

In addition, a building could consist of a single structure as above-described, or a plurality of side-by-side such structures. Offices, or the like, could be located in an upper part of the building above the structures.

The thickness of the upper platforms 45 and 49 at their window lines is preferably less than five inches whereby, if the platform is five feet above the ground, a viewer will be able to look into both the top and bottom display areas and he will also be able to see into both the top and bottom store units. The upper landings 9 and 11 may be wedge-shaped in cross-section with the thickness being increased in the inward direction.

Figure 3:
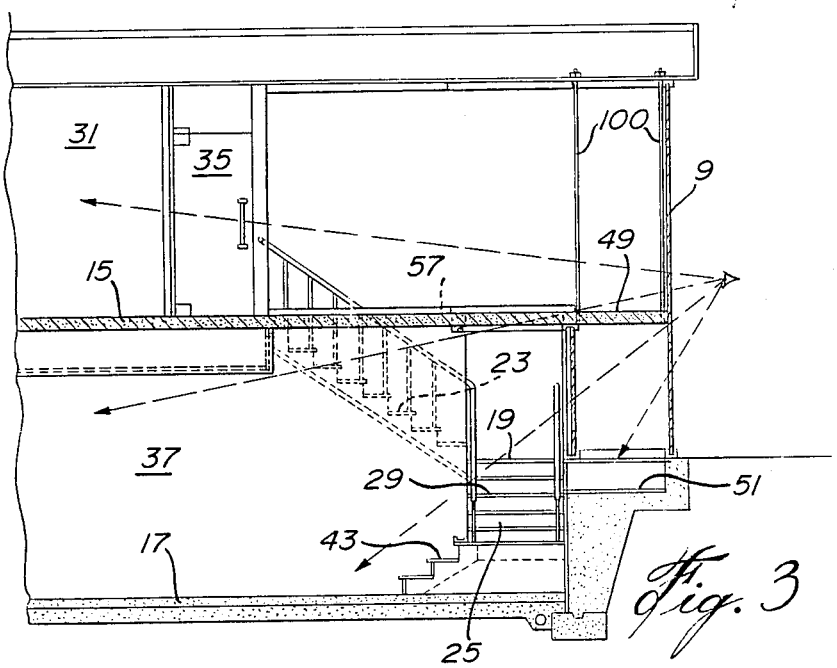
FIG. 3 is a section through III—III of FIG. 2.
Figure 4:
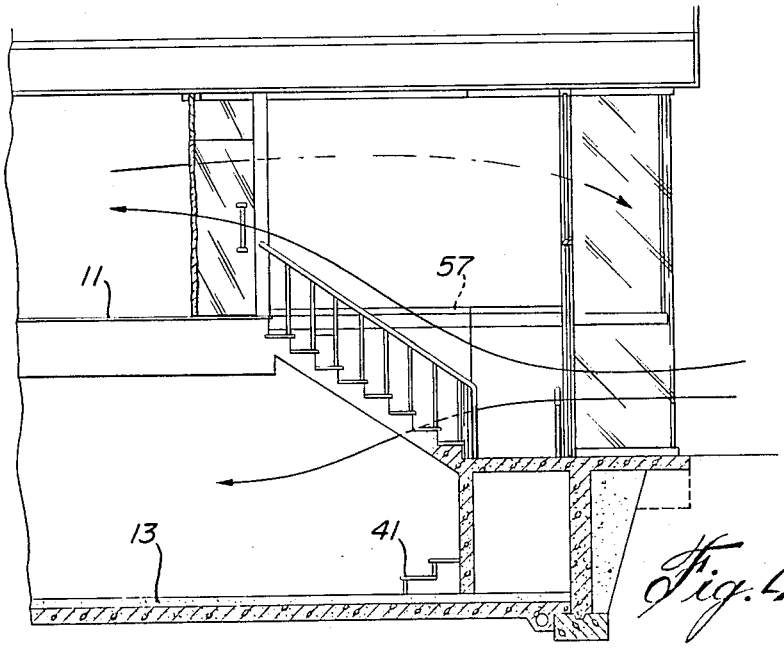
FIG. 4 is a section through IV—IV of FIG. 2.

In addition, as seen in FIG. 3, the platforms may be suspended by rods 100. Thus, the level of each platform could be adjusted for special needs. For example, if the lower level required a taller display area and the height of the upper level is not critical to the occupent, then the level of the platform could be lifted above the level of its adjacent upper landing. Thus, there is added a further degree of flexibility in the arrangement.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A structure for accommodation of multiple store units, said structure having a front wall, two side walls, a rear wall, a top wall and a bottom wall to define a confined space, said structure comprising:

an entranceway defined by a gap in said front wall, the entranceway having a threshold at a first level;

a first storefront window arrangement on one side of said entranceway in said front wall;

a second storefront window arrangement on the other side of said entranceway in said front wall;

said first and second window arrangements extending substantially over said front wall;

a first upper landing, in a horizontal plane above said first level, extending behind said front wall and said first storefront window arrangement to accommodate a first store unit, and a first lower landing, coincident with said bottom wall and below said first level, and behind said front wall and said first storefront window arrangement to accommodate a second store unit;

a second upper landing, in a horizontal plane above said first level, extending behind said front wall and said second storefront window arrangement to accommodate a third store unit, and a second lower landing, coincident with said bottom wall and below said first level, and behind said front wall and said second storefront window arrangement to accommodate a fourth store unit;

an entranceway landing having side edges and a rear edge extending within the confined space from the threshold of the entranceway in a horizontal plane at said first level but spaced between the upper and lower landings;

first access means extending from the rear edge of said entranceway landing towards said rear wall and ascending to said upper landings to service said first and third store units;

second access means extending from the side edges of said entranceway landing towards respective ones of said side walls and descending to said lower landings to service said second and fourth store units;

said first storefront window arrangement comprising a first, upper, storefront window and a second, lower, storefront window;

said second storefront window arrangement comprising a third, upper, storefront window and fourth lower, storefront window;

a first store unit being defined by said front wall and said first, upper, storefront window, said first upper landing, one of said side walls, said top wall and said rear wall;

a second store unit being defined by said front wall and said second, lower, storefront window, said first lower landing, said one of said side walls, said top wall and said rear wall;

said third store unit being defined by said front wall and said third, upper, storefront window, said second upper landing, the other one of said side walls, said top wall and said rear wall; and said fourth store window being defined by said front wall and said fourth, lower, storefront window, said second lower landing, said other one of said side walls, said top wall and said rear wall.

2. A structure as defined in claim 1 and including means for enclosing at least one of said store units.

3. A structure as defined in claim 1 and including:

a first enclosing means for enclosing said first store unit;

a second enclosing means for enclosing said second store unit;

a third enclosing means for enclosing said third store unit; and a fourth enclosing means for enclosing said fourth store unit.

4. A structure as defined in claim 3 wherein each said enclosing means comprises a movable wall, said movable wall being removable during operating hours of said respective store unit, and movable to enclose said respective store unit during closing hours of said respective store.

5. A structure as defined in claim 3 wherein each said enclosing means comprises a movable wall, said movable wall being removable during operating hours of said respective store unit, and movable to enclose said respective store unit during closing hours of said respective store;

each said movable wall including a lockable door.

6. A structure as defined in claim 1 wherein said first upper landing is at the same level as said second upper landing; and said first lower landing is at the same level as said second lower landing.

7. A structure as defined in claim 6 and including:

a first divider in said first storefront window arrangement aligned with said first upper landing to divide said first storefront window arrangement into a first upper storefront window and a first lower storefront window, said first divider extending to the window line of said first storefront window arrangement;

a second divider in said second storefront window arrangement aligned with said second upper landing to divide said second storefront window arrangement into a second upper storefront window and a second lower storefront window, said second divider extending to the window line of said second storefront window arrangement;

said first upper storefront window being associated with said first store unit;

said first lower storefront window being associated with said second store unit;

said second upper storefront window being associated with said third store unit; and said second lower storefront window being associated with said fourth store unit.

8. A structure as defined in claim 7 and including:

a first upper display platform associated with said first store unit comprising said first divider;

a first lower display platform associated with said second store unit;

a second upper display platform associated with said third store unit comprising said second divider; and a second lower display platform associated with said fourth store unit.

9. A structure as defined in claim 8 wherein said first and third upper display platforms are level with said first and third upper landings respectively; and wherein said first and second lower display platforms are below said ground level landing but above said first and second lower levels respectively.

10. A structure as defined in claim 8 wherein the thickness of said first and second upper platforms at their respective window lines is less than five inches.

11. A structure as defined in claim 8 wherein said first and second upper platforms are suspended by rods, whereby the levels of said first and second upper platforms may be adjusted.

12. A structure as defined in claim 1 wherein said entranceway comprises a door.

13. A structure as defined in claim 1 wherein the width of said first storefront window arrangement is equal to the width of said second storefront window arrangement.

* * * * *